US006444417B1

(12) United States Patent
Clarke et al.

(10) Patent No.: US 6,444,417 B1
(45) Date of Patent: Sep. 3, 2002

(54) PHOTOGRAPHIC ELEMENT CONTAINING CYAN DYE-FORMING COUPLER

(75) Inventors: David Clarke; Llewellyn J. Leyshon, both of Watford; Katie E. Smith, Bushey, all of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/934,284

(22) Filed: Aug. 21, 2001

(30) Foreign Application Priority Data

Sep. 20, 2000 (GB) ..... 0023093

(51) Int. Cl.[7] ..... G03C 1/08; G03C 7/26; G03C 7/32

(52) U.S. Cl. ..... 430/551; 430/546; 430/552; 430/553

(58) Field of Search ..... 430/543, 546, 430/551, 552, 553

(56) References Cited

U.S. PATENT DOCUMENTS

| | | | | |
|---|---|---|---|---|
| 4,463,086 A | | 7/1984 | Sasaki et al. | |
| 4,749,645 A | * | 6/1988 | Goddard | 430/551 |
| 4,980,275 A | * | 12/1990 | Goddard | 430/551 |
| 6,004,738 A | * | 12/1999 | Lau et al. | 430/551 |

FOREIGN PATENT DOCUMENTS

EP 0 913 729 A1 5/1999

OTHER PUBLICATIONS

JP Abstract 59074556 A.
JP Abstract 59102234 A.

* cited by examiner

*Primary Examiner*—Geraldine Letscher
(74) *Attorney, Agent, or Firm*—Arthur E. Kluegel

(57) ABSTRACT

The invention relates to a photographic element comprising a light sensitive silver halide emulsion layer having associated therewith (A) a cyan dye-forming coupler of formula (I) and (B) a bisphenol derivative compound of formula (II):

(I)

(II)

wherein the substituents are as described in the specification.

14 Claims, No Drawings

PHOTOGRAPHIC ELEMENT CONTAINING CYAN DYE-FORMING COUPLER

FIELD OF THE INVENTION

This invention relates to conventional and to redox-amplified silver halide colour photographic materials and more particularly to such materials which contain a dye-forming coupler in combination with certain non-imaging compounds. The resulting dyes exhibit an exceptional combination of photographic properties, especially in regard to hue and stability. The application is related to UK application number 00230896.6 of even date herewith.

BACKGROUND OF THE INVENTION

In a silver halide photographic element, a colour image is formed when the element is exposed to light and then subjected to colour development, generally with a primary aromatic amine developer. Colour development results in imagewise reduction of silver halide and production of oxidized developer. Oxidized developer reacts with one or more incorporated dye-forming couplers to form an imagewise distribution of dye.

In any polychromatic chromogenic photographic material it is desirable that the dyes so formed should have certain properties. For instance the dyes should be bright in colour, absorbing light in the appropriate spectral region, with very little secondary absorption so that good colour reproducibility is obtained. The dyes that are formed by any colour coupler during processing have a tendency to fade over time as a result of exposure to light, heat, humidity and oxygen. Since the three image dyes may not fade at the same rate, an apparent change in image colour may result. It is thus paramount that the formed photographic dye images should be resistant towards fading by heat, humidity and light.

When the dye images are formed in silver halide photographic materials from the combination of oxidized developer and an incorporated coupler, certain restrictions are placed on the properties of the coupler. For instance, the coupler should produce a dye which has the aforementioned desirable properties and the efficiency of the dye-forming reaction must be high. Additionally, the coupler must be easily dispersible, must itself be resistant towards the deleterious effects of light, heat and humidity and must have a low propensity to form fog.

It is well known in the art of coupler chemistry that when a functionality is incorporated into a molecule to achieve one of the aforementioned desirable properties (such as high dye light stability), quite often one or more of the other desirable properties of the photographically formed dye (such as its hue) is affected adversely. It is very difficult to obtain a coupler which manifests all or even most of the aforementioned desirable properties. For example, dyes formed by diacylaminophenolic cyan couplers, whilst exhibiting excellent resistance to fading by heat and humidity, are especially deficient in their ability to withstand the effects of light and their absorption bands tend to lie at shorter wavelengths than is desirable, particularly for colour paper applications.

It is also known that the dye forming efficiency of such couplers and the stability and absorption characteristics of their image dyes can be manipulated by incorporating certain functionalities into the molecular structure of the parent coupler. For example, JP 59074556 teaches that the use of 2,5-diacylaminophenolic couplers in which the 2-benzamido group is substituted with at least one ortho-fluorine atom gives cyan couplers of high coupling efficiency ($\gamma$, $D_{max}$) in addition to good image stability of derived image dyes. In a similar manner, DE 3329729 teaches that the use of a pentafluorobenzamide substituent at the 2-position of the coupler leads to desirable bathochromic hue shifts in their image dyes. In addition it is also well known that the chemical environment in which the image dye is situated can also influence the hue of the dye. Thus, JP 59102234 teaches that certain phenolic coupler solvents tend to shift the dye absorption band derived from the fluorobenzamide-substituted couplers mentioned above to longer wavelengths.

The use of certain phosphorus blocked bis-phenol phosphate esters o improve the thermal and light stability of cyan image dyes from 2,5-diacyl-minophenolic couplers has been described in EP-A-0 913 729. Couplers in which the 2-benzamide group is substituted with fluorine atoms are disclosed in this document, but there is there is nothing to indicate that any of such couplers disclosed therein provide particular advantages over non-fluorinated couplers in image dye light stability, nor that light stability is affected by the position of the s fluorine substituent.

PROBLEM TO BE SOLVED BY THE INVENTION

There is still a need to provide a photographic element comprising a cyan dye-forming formulation which can provide an image dye of good hue and further improved light stability without significant degradation of other photographic properties.

SUMMARY OF THE INVENTION

In accordance with the embodiment of the invention there is provided a photographic element comprising a light sensitive silver halide emulsion layer having associated therewith (A) a cyan dye-forming coupler of formula (I) and (B) a bisphenol derivative compound of formula (II):

(A)

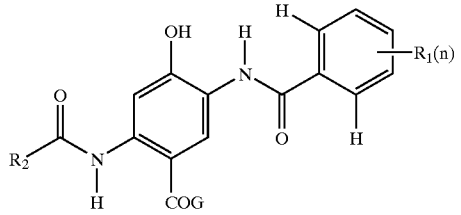

(I)

wherein each $R_1$ is a substituent provided that at least one of these is a fluoro or a perfluoroalkyl substituent;

n is an integer from 1 to 3;

$R_2$ is an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted, and COG is a hydrogen atom or a group which can be split off by the reaction of the coupler with an oxidized colour developing agent.

provided that (a) when n is 3 and each $R_1$ is fluorine, COG is not a methoxy group and (b) when n is 2 and $R_1$ in the 3- and 4-positions is each a fluorine atom, COG is not hydrogen;

(B)

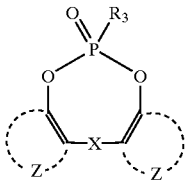

(II)

wherein $R_3$ is an unsubstituted or substituted alkyl, aryl, alkoxy, aryloxy group or a substituted amino group;

each Z independently represents the atoms necessary to complete a substituted or unsubstituted arene or heteroaromatic ring system;

X is a single bond or a linking group having a single atom which connects the arene or heteroaromatic ring systems; or X forms, together with substituents ortho to X on the arene or heteroaromatic ring systems, a fused unsubstituted or substituted 5-, 6- or 7-membered ring, which may contain one or two heteroatoms selected from nitrogen, oxygen and sulfur.

In another embodiment of the invention there is provided a multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element is as herein described.

In yet another embodiment of the invention there is provided a process of forming an image in a photographic element as hereinbefore defined after the element has been imagewise exposed to light, comprising contacting the element, as herein described, with a colour developing agent.

ADVANTAGEOUS EFFECT OF THE INVENTION

The element of the invention provides an image dye of good hue, exhibiting exceptional stability against the effects of light, without significant degradation of other photographic properties.

DETAILED DESCRIPTION OF THE INVENTION

The combination of the invention is generally as described in the Summary of the Invention. The combination comprises the compounds (I) and Cyan Dye-Forming Coupler (I)

The cyan dye-forming coupler has the formula (I):

(I)

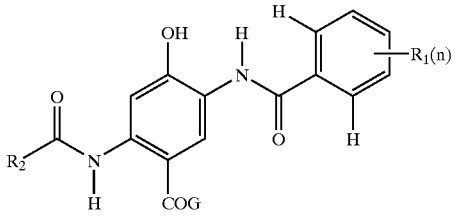

wherein each $R_1$ is a substituent provided that at least one of these is a fluoro or a perfluoroalkyl substituent;

n is an integer from 1 to 3;

$R_2$ is an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and COG is a hydrogen atom or a group which can be split off by the reaction of the coupler with an oxidized colour developing agent.

When $R_2$ is an amino or alkoxy group it may, for example, be substituted with a halogen, aryloxy or alkyl- or aryl-sulfonyl group. Suitably, however, $R_2$ is selected from an unsubstituted or substituted alkyl or aryl group or a 5–10 membered heterocyclic ring, such as a pyridyl, morpholino, imidazolyl or pyridazolyl group. $R_2$ is more preferably an alkyl group substituted, for example, with a halogen, alkyl, aryloxy or alkyl- or aryl-sulfonyl group, which may be further substituted.

In particular $R_2$ may be a group of the formula:

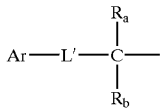

wherein

Ar is an unsubstituted or substituted aryl group, L' is a divalent linking group such as —O—, —SO— or —$SO_2$— and $R_a$ and $R_b$ are independently H or an alkyl group. In one embodiment, $R_a$ is an alkyl group, $R_b$ is H, and L' is —$SO_2$—.

However suitably $R^2$ is the group

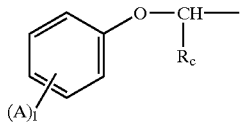

wherein each A is independently a substituent with at least one A being an alkyl-or aryl- sulfonamido or -sulfamoyl group, r is 1 or 2, and $R_c$ is hydrogen or an alkyl group. Preferably there is a halogen in the position ortho to the phenolic oxygen atom.

$R_1$ is at least one but preferably two fluoro or perfluoroalkyl substituents, especially fluoro or trifluoromethyl. Suitably, $R_1$ is a 3- or 4-fluorophenyl, 3- or 4-trifluoromethyl phenyl, 3,4-difluorophenyl, 3,5-difluorophenyl, 3,5 di-trifluoromethylphenyl, 3-fluoro,4-trifluoromethylphenyl or 3-trifluoromethyl,4-fluorophenyl. The ring may also be substituted with one of the substituents hereinbefore described for $R_2$ such as, for example, a chloro, cyano, alkylsulfonamido or alkylsulfonyl group.

COG is hydrogen or a coupling-off group, suitably a halogen atom or a group linked by an atom of sulfur, oxygen or nitrogen. Chloro groups are conveniently employed.

As used herein and throughout the specification unless where specifically stated otherwise, the term "alkyl" refers to an unsaturated or saturated, straight or branched chain alkyl group, including alkenyl and aralkyl, and includes cyclic alkyl groups, including cycloalkenyl, having 3–8 carbon atoms and the term "aryl" includes specifically fused aryl.

Specific examples of couplers of formula (I) include the following although the invention is not to be construed as limited thereto:
C-1
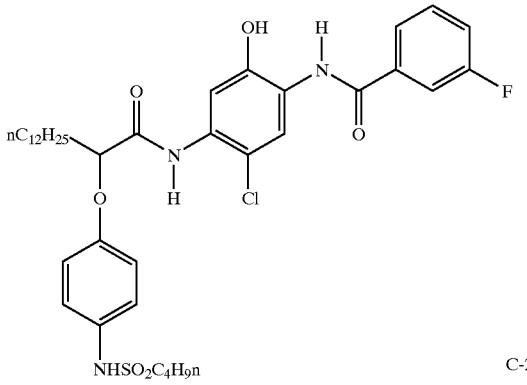
C-2
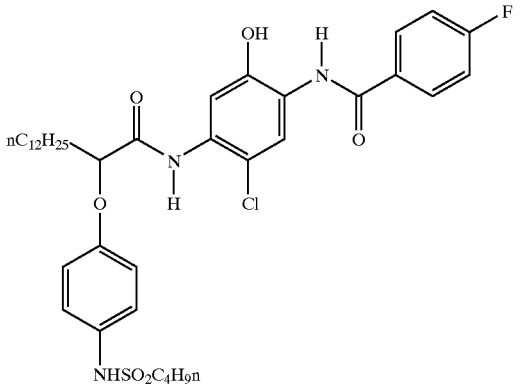
C-3
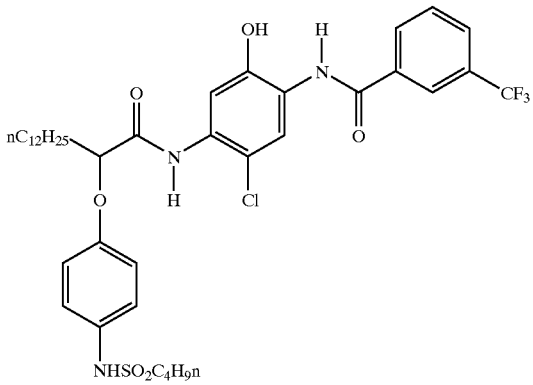
C-4
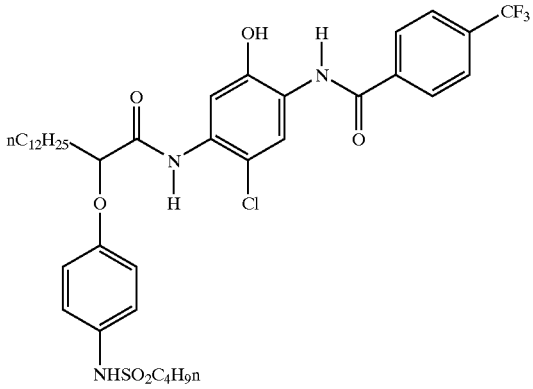
-continued
C-5
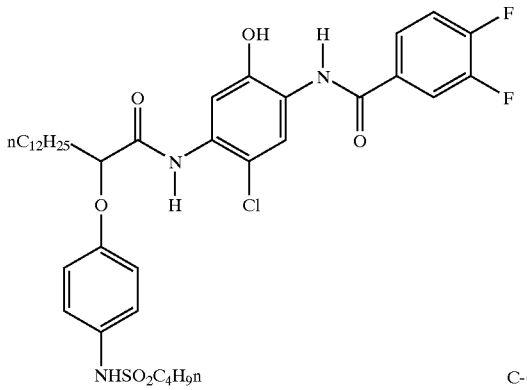
C-6
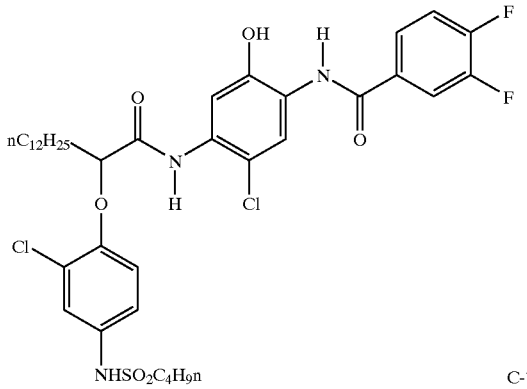
C-7
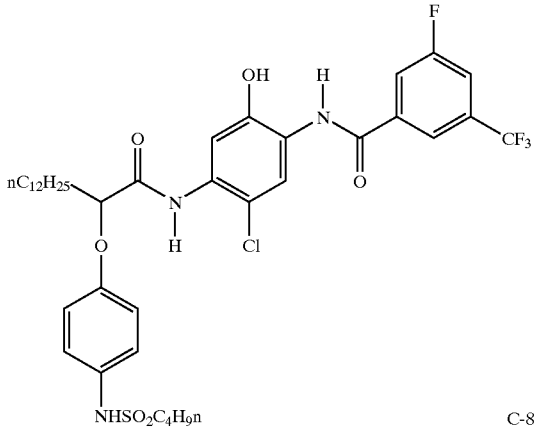
C-8
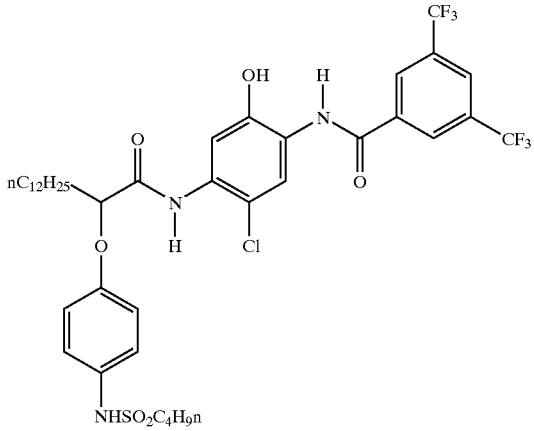

-continued
C-9
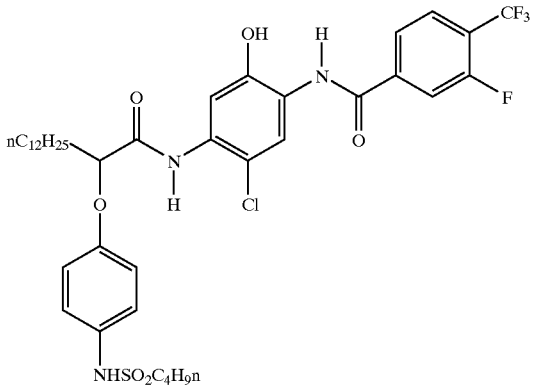
C-10
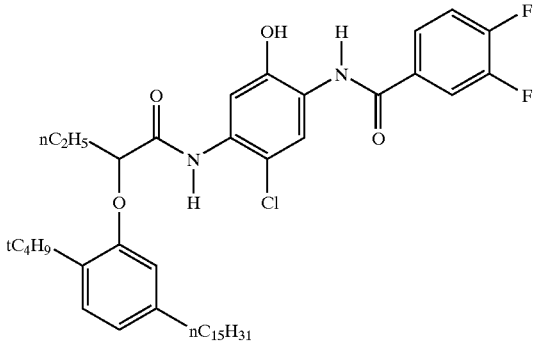
C-11
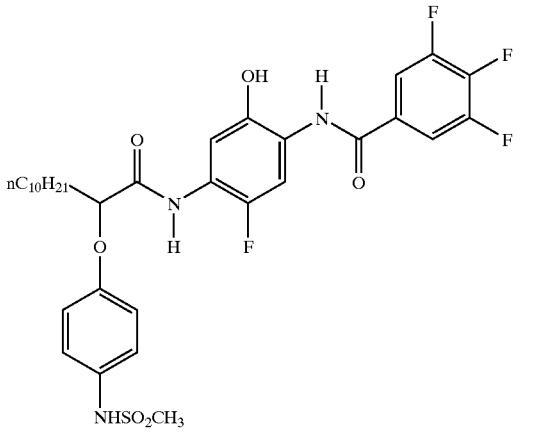
C-12
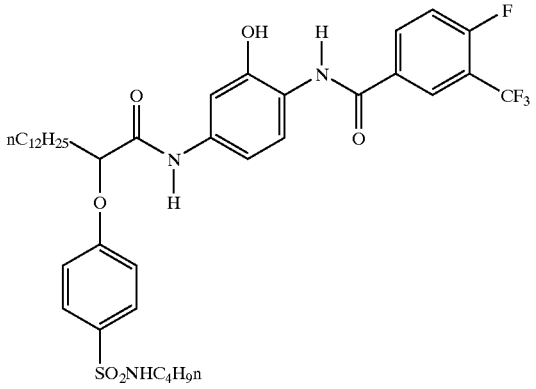
-continued
C-13
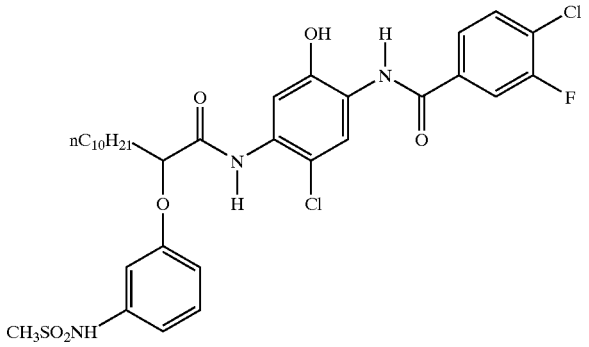
C-14
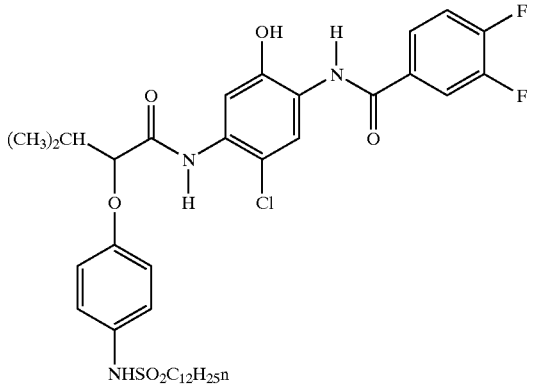
C-15
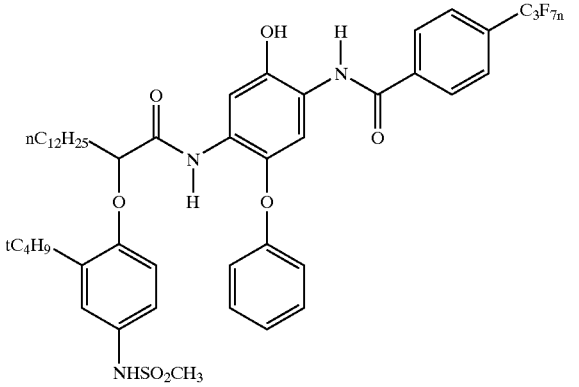
C-16
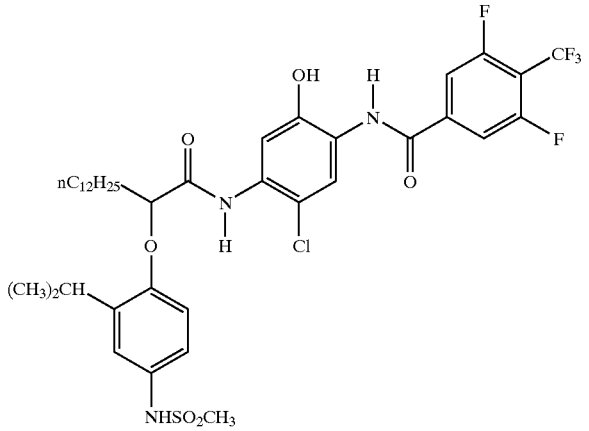

-continued
C-17
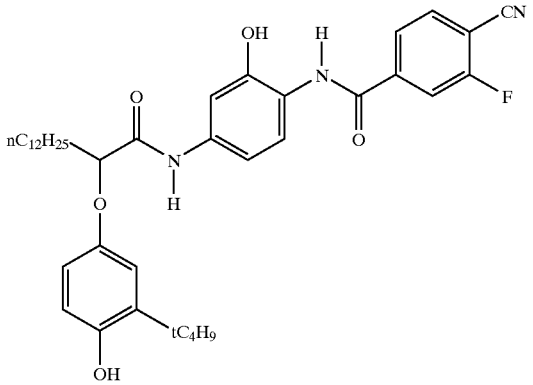
C-18
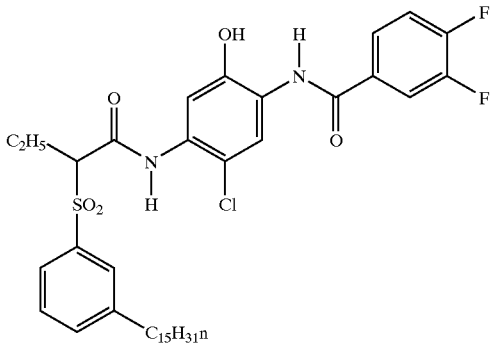
C-19
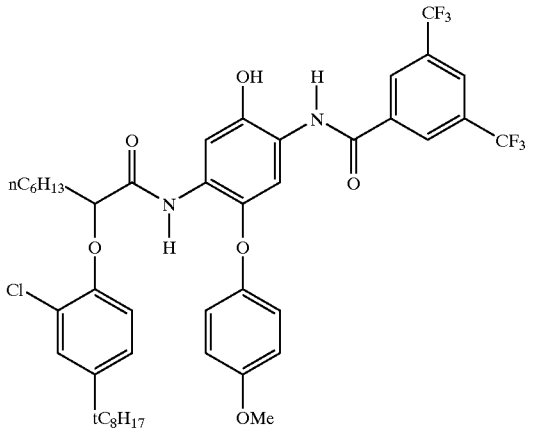
C-20
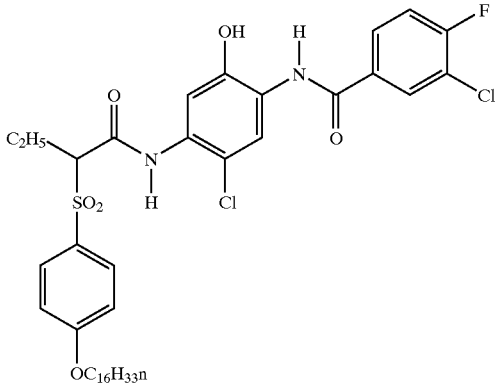
-continued
C-21
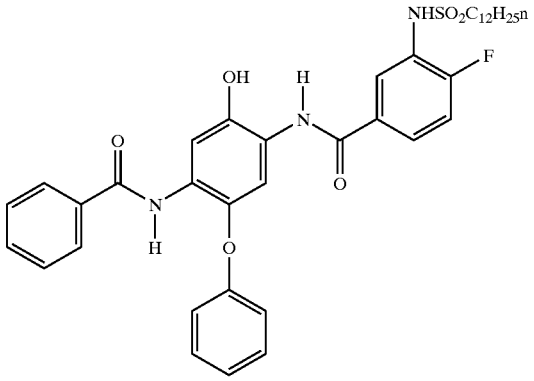
C-22
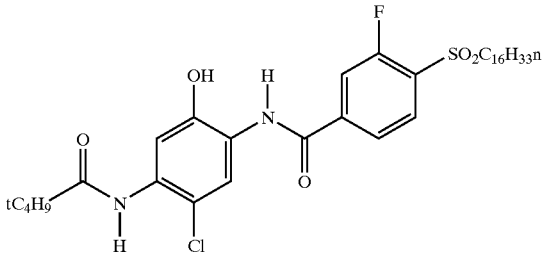
C-23
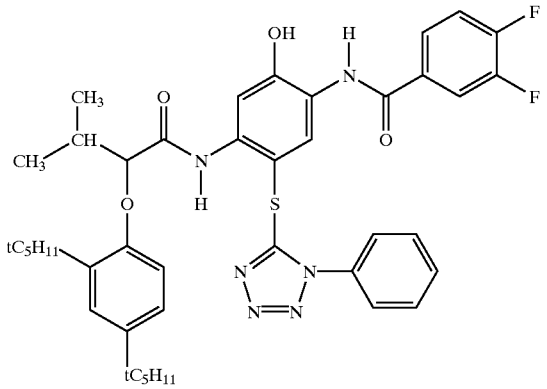
C-24
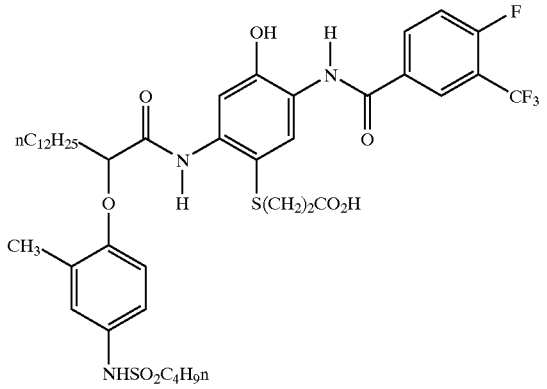

Bisphenol Stabilizer of Formula (II):

The bisphenol stabilizer has the formula (II):

(II)

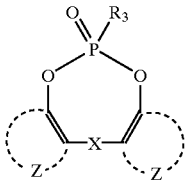

$R_3$ represents an unsubstituted or substituted alkyl, aryl, alkoxy, aryloxy group or a substituted amino group. Suitable examples include, for example, methyl, phenyl, ethoxy, phenoxy and dimethylamino groups.

Each Z represents the atoms necessary to form an arene or heterocyclic ring, such as a naphthalene, pyridine or quinoline ring, but preferably the atoms complete a phenyl ring, which may be substituted.

X is any linking group that presents a single atom between the arene or heteroaromatic ring systems and is preferably a divalent linking group selected from —CR'R"—, —NR—, —$S(O)_q$— and —O—, wherein R is an unsubstituted or substituted alkyl or aryl group, R' and R" are independently selected from hydrogen and an unsubstituted or substituted alkyl or aryl group and q is 0,1 or 2. Alternatively X may, together with substituents ortho to X on the arene or heteroaromatic ring systems, complete a fused 5-, 6- or 7-membered fused ring system which may be substituted or contain one or two heteroatoms selected from nitrogen, oxygen and sulfur. However X is preferably a sulfur atom or an oxygen atom or more preferably an unsubstituted or substituted methylene group.

A preferred formula (II) is represented by formula (IIA)

(IIA)

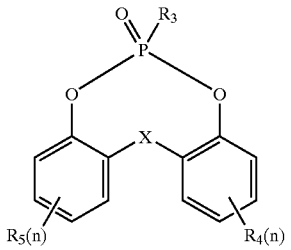

wherein $R_3$ is as hereinbefore defined;

R4 and $R_5$ are each independently selected from halogen or an unsubstituted or substituted alkyl, aryl, alkoxy, aryloxy, COOR or CONR'R" group, where R, R' and R" are as hereinbefore defined;

each n is independently an integer from 1 to 4; and

X is a single bond or a linking group having a single atom which connects the phenyl rings; or X forms together with $R_4$ and $R_5$, when in the ortho position, a fused unsubstituted or substituted 5-, 6-or 7-membered ring, which may contain one or two heteroatoms selected from nitrogen, oxygen and sulfur.

Although $R_4$ and $R_5$ may be the same or different, conveniently they are the same for ease of synthesis and are preferably selected from unsubstituted or substituted alkyl, aryl or alkoxy groups or halogen atoms, most preferably unsubstituted alkyl groups. Conveniently each n is 2 and the substituents are preferably in the ortho and para positions.

In a more preferred embodiment the stabilizer has the formula (IIB)

(IIB)

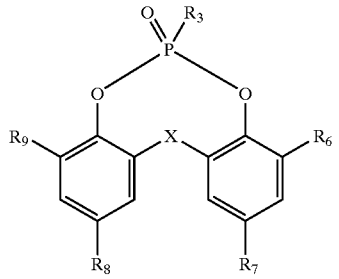

wherein $R_6$, $R_7$, $R_8$ and $R_9$ are independently selected from hydrogen or halogen atoms or unsubstituted or substituted alkyl, aryl or alkoxy groups, preferably alkyl groups and especially secondary or tertiary alkyl groups. Although $R_6$, $R_7$, $R_8$ and $R_9$ may be the same or different, conveniently $R_6$ and $R_9$ are the same for ease of synthesis, especially alkyl groups, as are $R_7$ and $R_8$, which are especially halogen atoms or alkyl groups.

Specific examples of a stabilizer of formula (II) include the following although the invention is not to be construed as limited thereto:

ST1

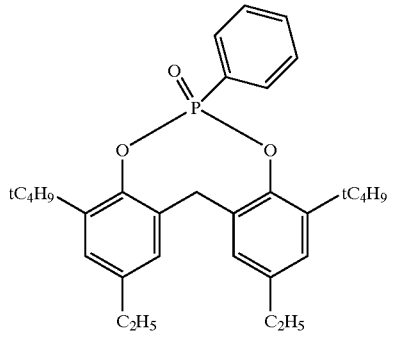

ST2

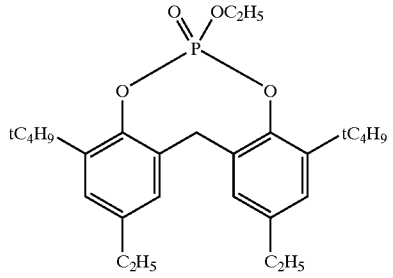

ST3

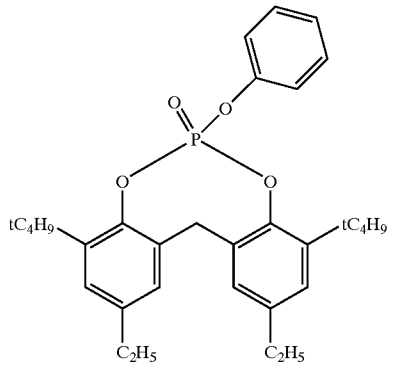

-continued
ST4
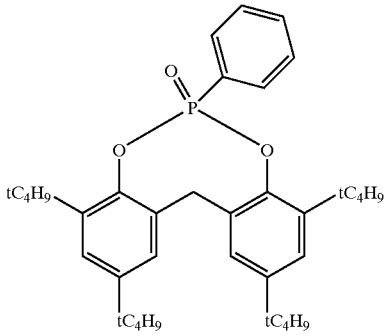
ST5
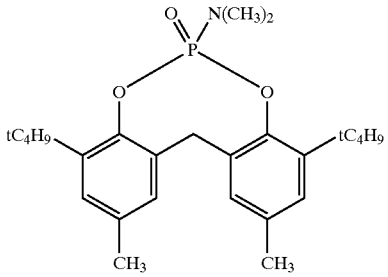
ST6
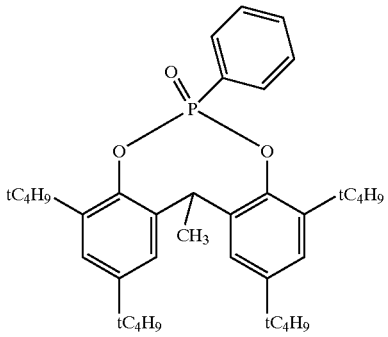
ST7
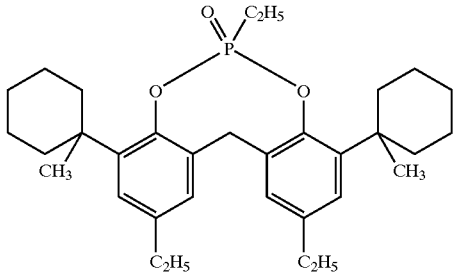
ST8
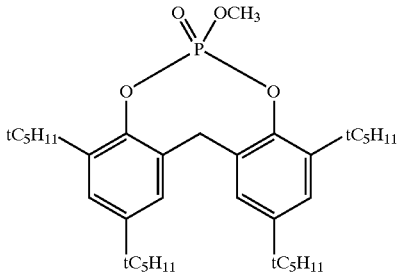
-continued
ST9
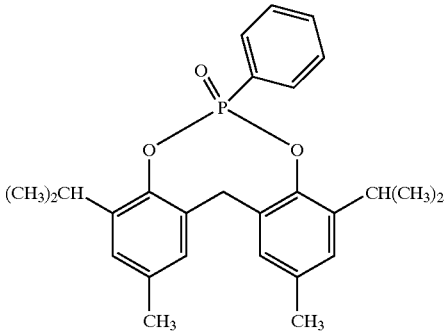
ST10
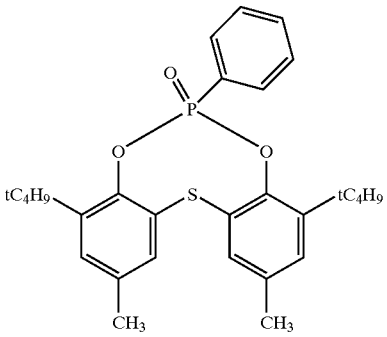
ST11
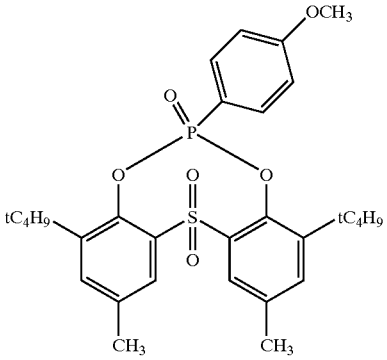
ST12
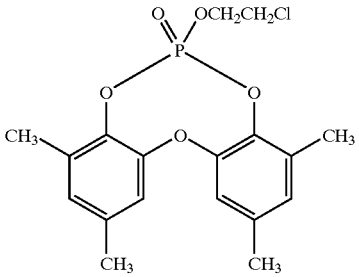
ST13
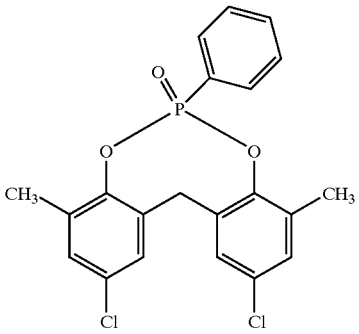

-continued
ST14
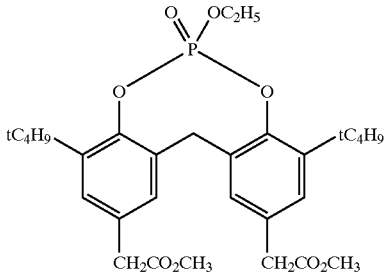
ST15
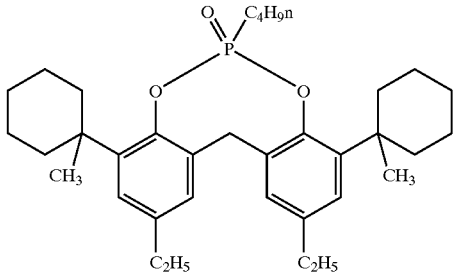
ST16
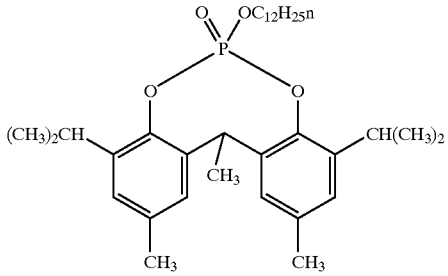
ST17
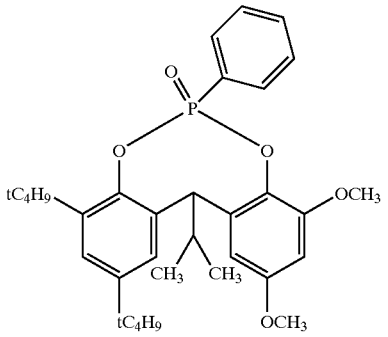
ST18
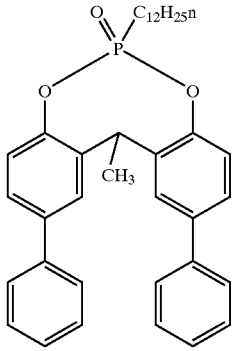
-continued
ST19
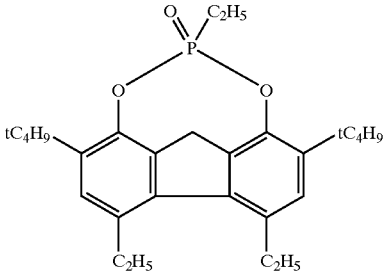
ST20
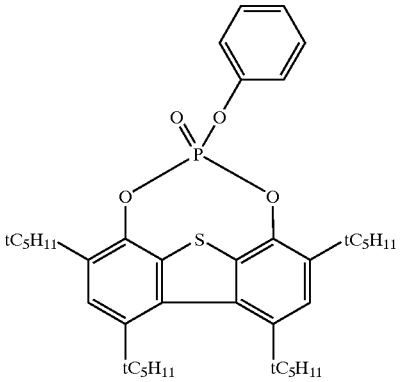
ST21
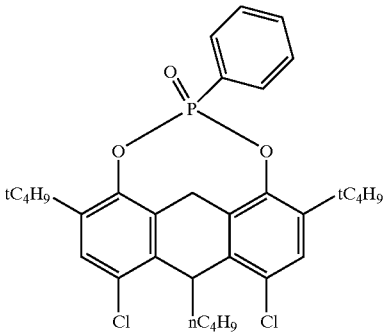
ST22
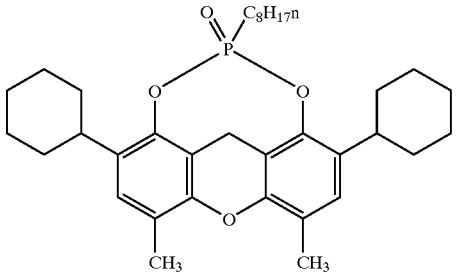
ST23
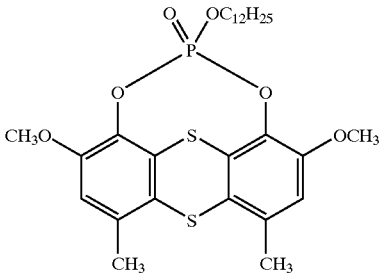

-continued

ST24

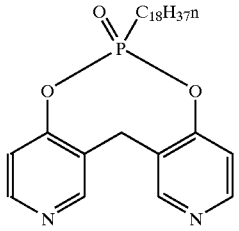

ST25

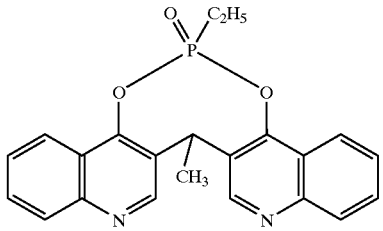

ST26

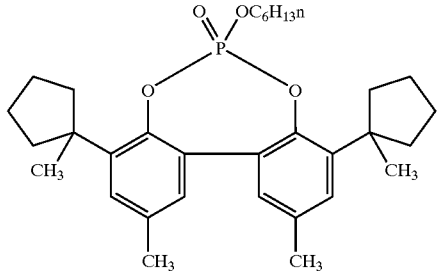

The stabilizer and couplers for use in the invention are incorporated by dissolving the materials in one or more high-boiling permanent organic solvents, with or without a low-boiling or partially water-soluble auxiliary organic solvent. A blend of permanent solvents may be advantageous to optimise the desired features, such as solubility, dye hue, thermal or light stability or the coupling reactivity of the dispersions.

The resulting organic solution may then be mixed with an aqueous gelatin solution and the mixture passed through a mechanical mixing device suitable for high-shear or turbulent mixing generally suitable for preparing photographic emulsified dispersions, as described in EP-A-1 037 103, incorporated herein by reference.

It has been found with the cyan dye-forming couplers of formula (I) that it is advantageous for the formulation to include an H-donor coupler solvent of general formula (III) to provide the desirable combination of dye hue and stability of the image dye to light fade. With such a solvent the absorption characteristics of the image dye are shifted to a more favourable region.

(III)

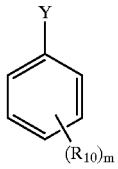

wherein each $R_{10}$ is a substituent and m is an integer of from 1 to 3 and the total number of the carbon atoms contained in all of the Rio groups is at least 8; and Y is OH or $NHSO_2R'''$, wherein R''' is an unsubstituted or substituted alkyl or aryl group or a 5–10 membered heterocyclic ring which contains one or more heteroatoms selected from nitrogen, oxygen and sulfur, which ring is unsubstituted or substituted;

The size of the substituent group(s) is influential in accomplishing both of these results. Suitably at least one of the groups is an alkyl group or a substituted alkoxy group. Typical examples are a single alkyl group of 8 to 15 carbon atoms or two alkyl groups of 4 or 5 carbon atoms each.

Specific examples of a solvent of formula (II) include the following although the invention is not to be construed as limited thereto:

(S1)

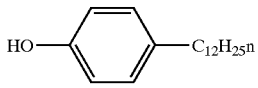

(S2)

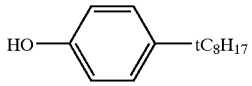

(S3)

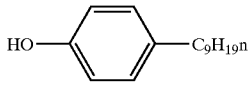

(S4)

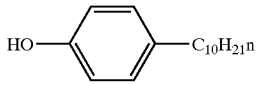

(S5)

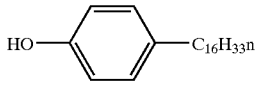

(S6)

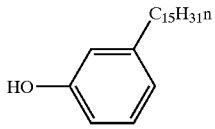

(S7)

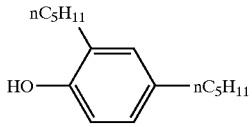

(S8)

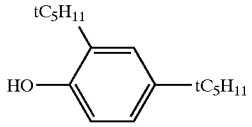

(S9)

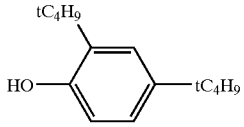

(S10)

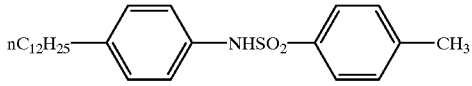

(S11)

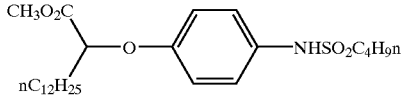

Suitable laydowns of the cyan dye-forming coupler are from about 0.1 $g/m^2$ to about 2 $g/m^2$, preferably from about 0.3 $g/m^2$ to about 0.7 $g/m^2$. The ratio of stabilizer to coupler by weight is from about 0.1:1 to about 5:1, preferably from about 0.5:1 to about 2:1, but more preferably the stabilizer and coupler are in about equal amounts by weight. The ratio of solvent to coupler by weight is from about 0.2:1 to about 4:1, preferably from about 0.5:1 to about 2:1.

Unless otherwise specifically stated or when the term "group" is used, it is intended throughout this specification, when a substituent group contains a substitutable hydrogen, to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorus, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentyl-phenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyl-oxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentyl-phenoxy) butyramido, alpha-(3-pentadecylphenoxy)hexanamido, alpha-(4-hydroxy-3-t-butylphenoxy)-tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxy-carbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]-carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyl-oxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)-ethylthio, phenylthio, 2-butoxy-5-t-octylphenylthio, an[0084] p-tolylthio; acyloxy, such as acetyloxy, benzoyloxy, octadecanoyloxy, p-dodecylamidobenzoyloxy, N-phenyl-carbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials for use in the invention can be used in any of the ways and in any of the combinations known in the art. Typically, the materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized colour developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobic or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single colour elements or multicolour elements. Multicolour elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolour photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94–6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. colour negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Colour materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with colour reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation and colour correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, heterooxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colourless products upon reaction with oxidized colour developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colourless products on reaction with an oxidized colour developing agent.

Couplers that form black dyes upon reaction with oxidized colour developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized colour developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" coloured couplers (e.g. to adjust levels of interlayer correction) and, in colour negative applications, with masking couplers such as those described in EP 0 213 490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The materials for use in the invention may be used in association with materials that release "photographically useful groups" (PUGS) that accelerate or otherwise modify the processing steps e.g. of bleaching or fixing to improve the quality of the image. Bleach accelerator releasing couplers such as those described in EP 0 193 389; EP 0 301 477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 5 4,859,578; U.S. Pat. No. 4,912,025); antifogging and anti colour-mixing agents such as derivatives of hydroquinones, aminophenols, amines, gallic acid; catechol; ascorbic acid; hydrazides; sulfonamidophenols; and non colour-forming couplers.

The materials for use in the invention may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556 and U.S. Pat. No. 4,543,323.) Also, the compositions may be blocked or coated in protected form as described, for example, in Japanese Application 61/258,249 or U.S. Pat. No. 5,019,492.

The materials for use in the invention may further be used in combination with image-modifying compounds that release PUGS such as "developer inhibitor-releasing" compounds (DIRs). DIRs useful in conjunction with the compositions used in the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 0 272 573; 0 335319; 0 336 411; 0 346 899; 0 362 870; 0 365 252; 0 365 346; 0 373 382; 0 376 212; 0 377 463; 0 378 236; 0 384 670; 0 396 486; 0 401 612; 0 401 613.

Such compounds are also disclosed in "Developer-Inhibitor-Releasing (DIR) Couplers for Colour Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulae:

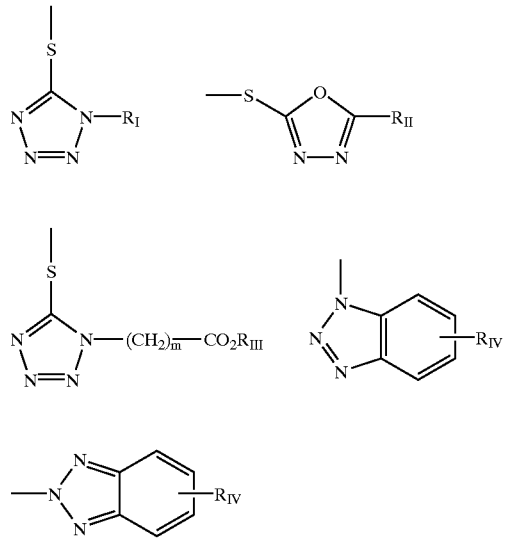

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different colour as one associated with a different film layer. It may also be useful that the coupler moiety included in the developer inhibitor-releasing coupler forms colourless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system is (U.S. Pat. No. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulae:

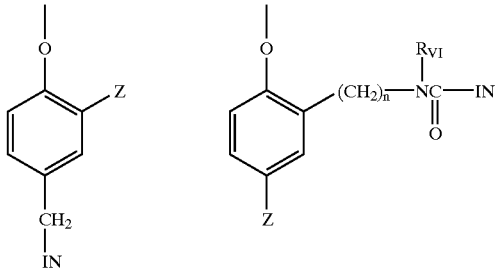

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

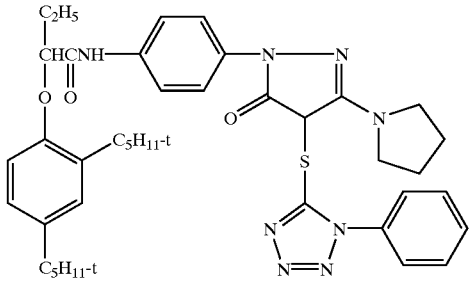

-continued

D2

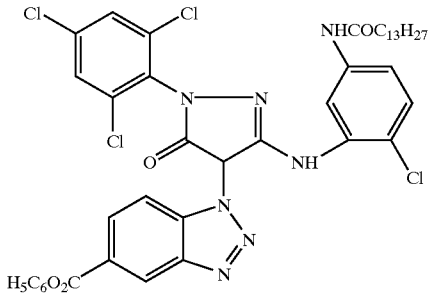

D3

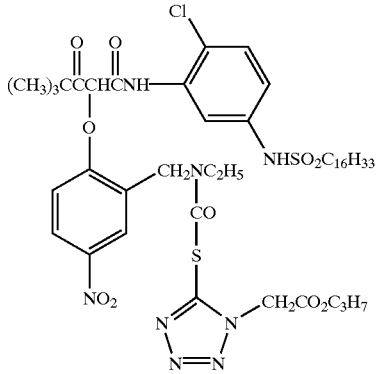

D4

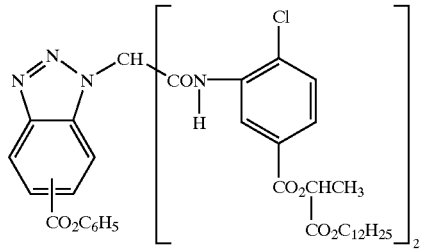

D5

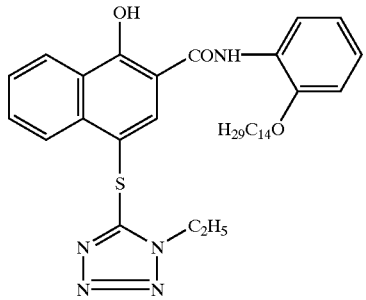

-continued

D6

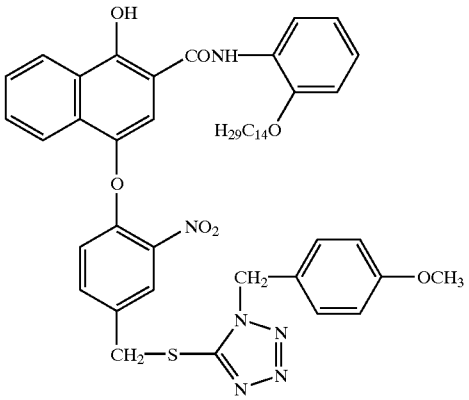

D7

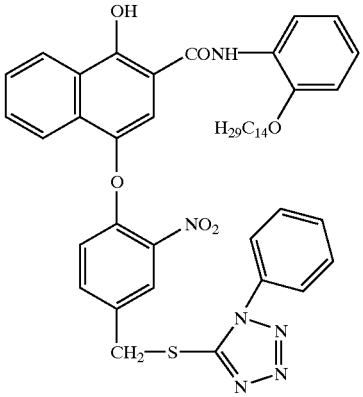

D8

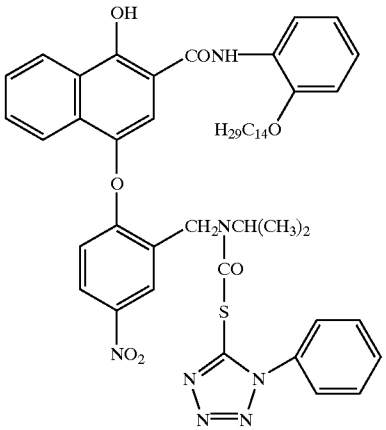

D9

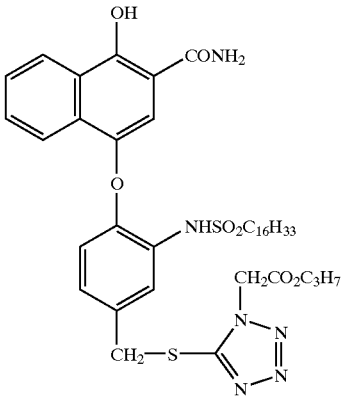

-continued

D10

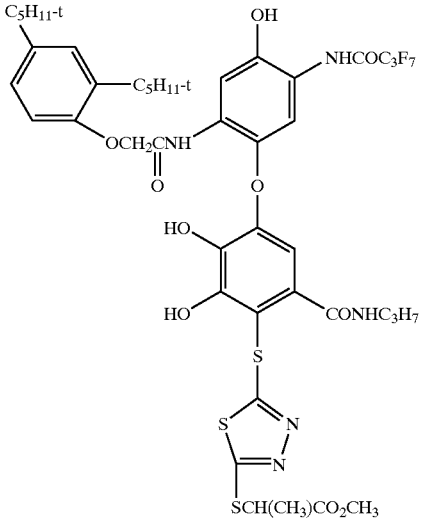

D11

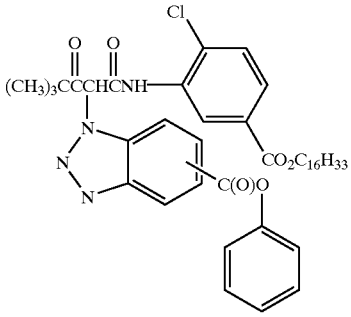

D12

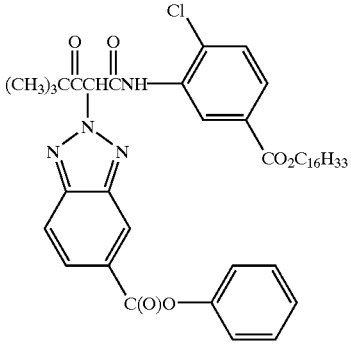

It is also contemplated that the concepts of the present invention may be employed to obtain reflection colour prints as described in *Research Disclosure*, November 1979, Item 18716, available from Kenneth Mason Publications, Ltd, Dudley Annex, 12a north Street, Emsworth, Hampshire P0101 7DQ, England, incorporated herein by reference. Materials for use in the invention may be coated on pH adjusted support as described in U.S. Pat. No. 4,917,994; on a support with reduced oxygen permeability (EP 0 553 339); with epoxy solvents (EP 0 164 961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Any silver halide combination can be used for the photographic element, such as silver chloride, silver chlorobromide, silver chlorobromo-iodide, silver bromide, silver bromoiodide or silver chloroiodide. In cases where the emulsion composition is a mixed halide, the minor component may be added in the crystal formation or after formation as part of the sensitization or melting. The shape of the silver halide emulsion grain can be cubic, pseudo-cubic, octahedral, tetradecahedral or tabular. The emulsions may be precipitated in any suitable environment such as a ripening environment, a reducing environment or an oxidizing environment as described in EP-A-1 037 103, incorporated herein by reference.

Tabular grain silver halide emulsions can be used in this invention. Specifically contemplated tabular grain emulsions are those in which greater than 50 percent of the total projected area of the emulsion grains are accounted for by tabular grains having a thickness of less than 0.3 micrometer (0.5 micrometer for blue sensitive emulsion) and an average tabularity (T) of greater than 25 preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.07$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mol percent iodide tabular grain silver bromoiodide emulsion having a grain thickness of0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a colour developing agent to reduce developable silver halide and oxidize the colour developing agent. Oxidized colour developing agent in turn reacts with the coupler to yield a dye.

With negative-working silver halide, the processing step described above provides a negative image. One type of such element, referred to as a colour negative film, is designed for image capture. Speed (the sensitivity of the element to low light conditions) is usually critical to obtaining sufficient image in such elements. Such elements are typically silver bromoiodide emulsions and may be processed, for example, in known colour negative processes such as the Kodak C-41™ process as described in The British Journal of Photography Annual of 1988, pages 191–198. If a colour negative film element is to be subsequently employed to generate a viewable projection print as for a motion picture, a process such as the Kodak ECN-2™ process described in the H-24 Manual available from Eastman Kodak Co. may be employed to provide the colour negative image on a transparent support. Colour negative development times are typically 3 min. 15 sec. or less and desirably 90 or even 60 sec. or less.

The photographic element of the invention can be incorporated into exposure structures intended for repeated use or exposure structures intended for limited use, variously referred to by names such as "single use cameras", "lens with film" or "photosensitive material package units".

Another type of colour negative element is a colour print. Such an element is designed to receive an image optically printed from an image capture colour negative element. A colour print element may be provided on a reflective support for reflective viewing (e.g. a snap shot) or on a transparent support for projection viewing as in a motion picture. Elements destined for colour reflection prints are provided on a reflective support, typically paper, employ silver chloride emulsions, and may be optically printed using the so-called negative-positive process where the element is exposed to light through a colour negative film which has been processed as described above. The print may then be processed to form a positive reflection image using, for example, the Kodak RA-4™ process as described in The British Journal of Photography Annual of 1988, pp 198–199. Colour projection prints may be processed, for example, in accordance with the Kodak ECP-2™ process as described in the H-24 Manual. Colour print development times are typically 90 sec. or less and desirably 45 or even 30 sec. or less.

A reversal element is capable of forming a positive image without optical printing. To provide a positive (or reversal) image, the colour development step is preceded by development with a non-chromogenic developing agent to develop exposed silver halide, but not form dye, and followed by uniformly fogging the element to render unexposed silver halide developable. Such reversal emulsions are typically sold with instructions to process using a colour reversal process such as the Kodak E-6™ process. Alternatively, a direct positive emulsion can be employed to obtain a positive image.

The above emulsions are typically sold with instructions to process using the appropriate method such as the mentioned colour negative (Kodak C-4™), colour print (Kodak RA-4™), or reversal (Kodak E-6™) process.

Preferred colour developing agents are p-phenylenediamines such as:

- 4-amino-N,N-diethylanilne hydrochloride,
- 4-amino-3-methyl-N,N-diethylaniline hydrochloride,
- 4-amino-3-methyl-N-ethyl-N-(2-methanesulfonamidoethyl)aniline sesquisulfate hydrate,
- 4-amino-3-methyl-N-ethyl-N-(2-hydroxyethyl)aniline sulfate,
- 4-amino-3-(2-methanesulfonamidoethyl)-N,N-diethylaniline hydrochloride, and
- 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

EXAMPLES

The following examples illustrate the preparation and photographic use of the compounds of this invention. It is to be understood that the invention is not limited to the chosen examples. The structure of the comparative couplers used are as follows:

CC-1

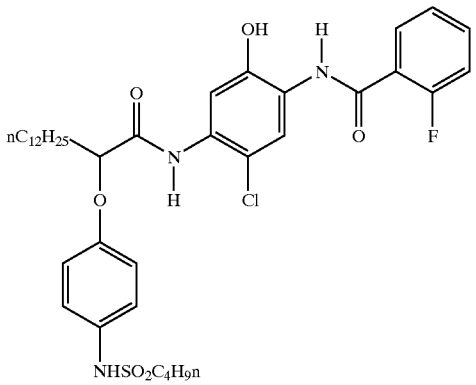

-continued

CC-2

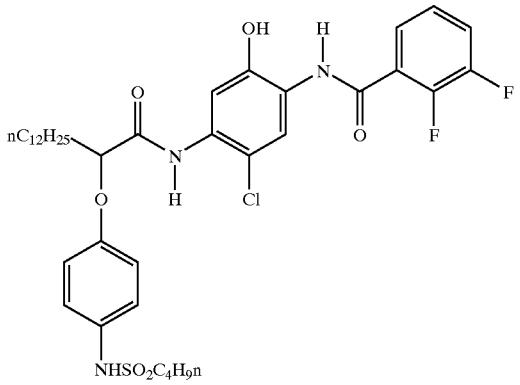

CC-3

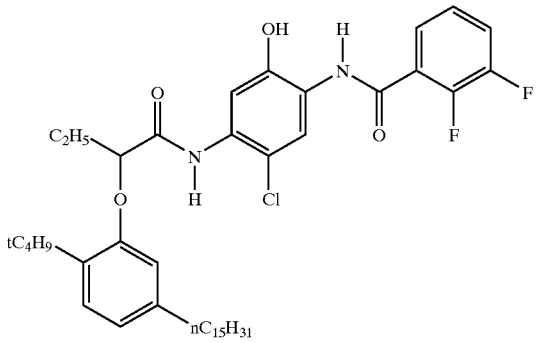

CC-4

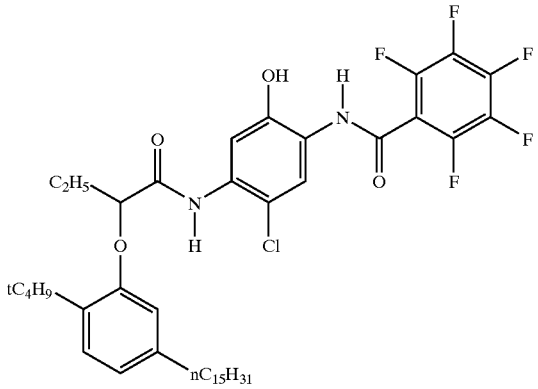

CC-5

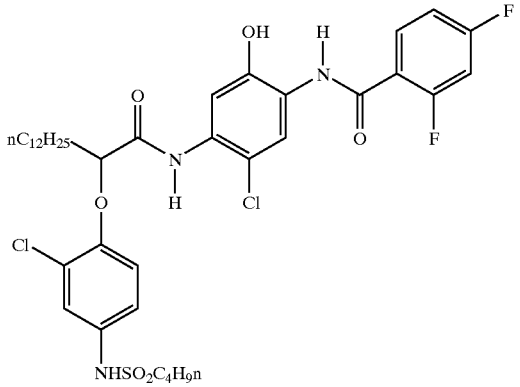

The synthesis of couplers follows the general scheme shown below and detailed experimental information is given in Example 1 for coupler C-5.

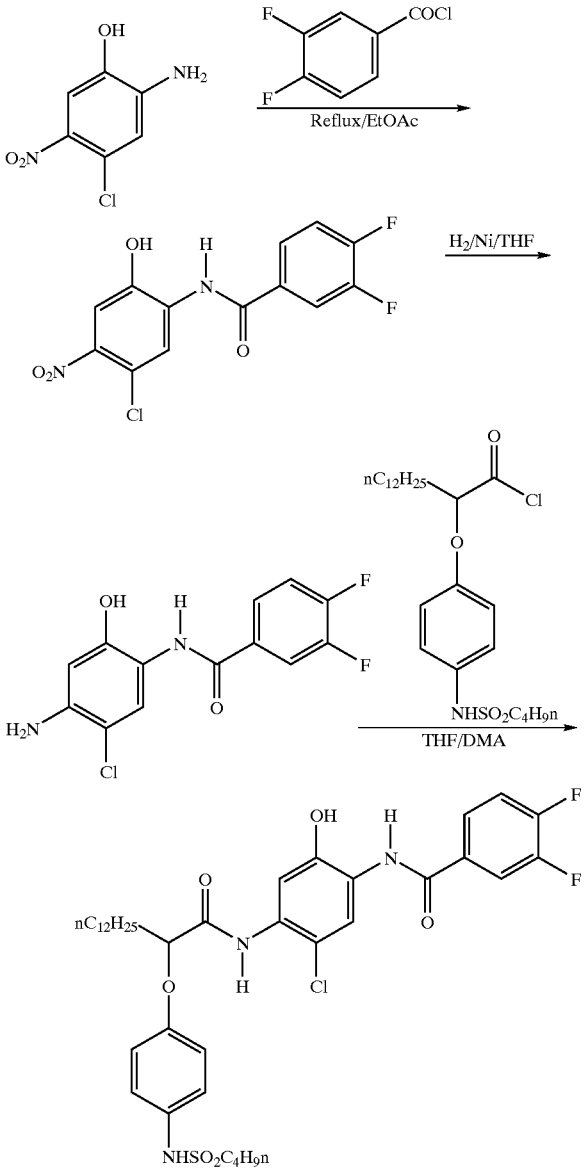

The bisphenol derivative compounds of formula (II) can be prepared from the corresponding commercially available bisphenol as described in EP-A-O 913 729 and as exemplified below in Example 2 for ST1.

All the coupler solvents of formula (III) used with advantage in this invention were available either commercially or prepared using standard techniques.

Example 1

Synthesis of Coupler C-5

(i) Preparation of 2-(3,4-Difluorobenzamido)-4-chloro-5-nitrophenol 2-Amino-4-chloro-5-nitrophenol (23.0 g, 0.10 mol) was slurried in ethyl acetate (250 ml). 3,4-Difluorobenzoyl chloride (25.0 g, 0.12 mol) was added and the reaction mixture refluxed for 2 h. Afterwards, solvent was reduced in vacuo to about one-half of original volume and the product diluted with 60/80 petrol (200 ml). The resulting precipitate was filtered washing well with 5:1 ethyl acetate-petrol mixture. Filtration gave the product as a beige solid, 25.5 g, (64%).

The correct structure was confirmed by ir, nmr and mass spectra.

(ii) Preparation of 2-(3,4-Difluorobenzamido)-4-chloro-5-aminophenol

The nitrophenol (25.0 g, 0.075 mol) was taken up in tetahydrofuran (THF) (250 ml) and dimethylformamide (DMF) (50 ml). The solution was hydrogenated over Raney Nickel at 3,040 kPa/25° C. for 15 h. The catalyst was removed by filtration through a Kieselguhr pad and the crude aminophenol solution used immediately for the next stage of the reaction.

(iii) Preparation of Coupler C-5

The amine solution from the previous stage (0.075 mol) was stirred with dimethylaniline (20 ml) then freshly prepared ballast acid chloride (40.5 g, 0.085 mol) in THF (50 ml) was added dropwise over 15 min. The product was stirred at room temperature for a further 2 h after which tlc showed no remaining amine. Solvent was removed under vacuum to about ⅓ volume and the residue partitioned between ethyl acetate and dilute hydrochloric acid (300 ml of each). The organic layer was washed further with water then separated and dried over over magnesium sulphate. Removal of solvent under reduced pressure gave a brown viscous oil which was crystallised (×3) from acetonitrile to give the product coupler as a white solid 28.6 g (51%).

Calcd. for $C_{37}H_{48}ClF_2N_3O_6S$: C, 60.4; H, 6.6; N, 5.7%; Found: C, 60.5; H, 6.5; N, 5.6%; HPLC gave a purity of 99% and the correct structure was further confirmed by nmr and mass spectra.

Example 2

Synthesis of Stabilizer ST1

2,2'-Methylenebis(6-t-butyl-4-ethylphenol) (74.0 g, 0.2 mol) was dissolved in toluene (300 ml) and stirred in an acetone-ice bath. Triethylamine (46.0 g, 0.45 mol) and 4-dimethylaminopyridine (6.0 g, 0.05 mol) were added followed the controlled addition of phenyl phosphonic dichloride (0.22 mol) over 0.5 h. Stirring was allowed to continue at room temperature for a further 16 h., then the heavy precipitate of triethylamine hydrochloride filtered off and discarded. The filtrate was evaporated to dryness the partitioned between ethyl acetate and dilute hydrochloric acid (300 ml each). The organic layer was separated and dried ($MgSO_4$) then solvent removed in vacuo to give the crude product as a viscous oil which gradually solidified. The material was purified by column chromatography in silica, eluting with a 10:1 mixture of 60/80 petrol-ethyl acetate. The product was obtained as a pale yellow solid which was triturated with 60/80 petrol to give colorless crystals, 51.2 g, (52%).

Calcd. for $C_{31}H_{39}O_3P$: C, 75.9; H, 8.0%; Found: C, 75.7; H, 7.8%;

HPLC gave a purity of 99% and the correct structure was further confirmed by nmr/mass spectra.

PHOTOGRAPHIC EXAMPLES

Example 3

Preparation and Evaluation of Illustrative Coatings (a)

Coupler C-1 was dispersed in gelatin according to the following procedure:

Coupler C-1 (4.94 g, 6.88mmol) and an equal weight of stabilizer ST1 were dissolved in a mixture of coupler solvent S1 (4.94 g) and ethyl acetate (2 g). The mixture was heated to effect solution. After adding aqueous gelatin (40 g, 10%), containing 0.25% di-isopropylnaphthalene sulfonic acid (sodium salt) surfactant, at 60C, the mixture was dispersed by ultrasonic agitation for 2 min., using a Dawe Instruments "Soniprobe". The resultant dispersion was diluted to 60 g with water.

Similar dispersions of couplers C2–C9 were likewise prepared, using the same molar weight of coupler in each, with proportionate adjustment of the weight of stabilizer ST1 and coupler solvent S1. A further two dispersions were subsequently prepared in the same fashion, replacing the above couplers with the comparison couplers CC1–CC2.

Each of the above dispersions was mixed with appropriate quantities of aqueous gelatin and a red-sensitive cubic silver chloride photographic emulsion (average edge length: 0.36 $\mu$m) before coating on a resin-coated paper support carrying a pre-coated gel pad (3 $g.m^{-2}$). The silver and coupler coverages were, respectively, 0.21 $g.m^{-2}$ and 0.831 $mmol.m^{-2}$. A protective gelatin supercoat (1.0 $g.m^{-2}$), containing an appropriate quantity of bis-(vinylsulfonylmethane) hardener, was applied over the photosensitive layer.

The full coating structure is shown below.

| | | |
|---|---|---|
| Gel | 1.0 $g.m^{-2}$ | GEL SUPERCOAT |
| Hardener* | 0.084 $g.m^{-2}$ | |
| Coupler | 0.831 $mM.m^{-2}$ | PHOTOSENSITIVE LAYER |
| Ag | 0.21 $g.m^{-2}$ | |
| Gel | 1.615 $g.m^{-2}$ | |
| Gel | 3.0 $g.m^{-2}$ | GELPAD |

Resin Coated Paper
*Hardener = bis(vinylsulfonylmethane)

Sample strips of the coatings were exposed through a step tablet (density range 0–3, 0.15 inc.) and developed through standard KODAK RA4™ process solutions. Sensitometric curves were generated for each coating and the spectral absorption characteristics of the image dyes were also measured using a spectrophotometer operating in reflection mode. The light stability of the image dyes was assessed using standard simulated daylight fading equipment incorporating a Xenon arc source, delivering an exposure intensity of 50klx at the sample plane. The sample strips were mounted in the fader under a uv-absorbing filter, comprising Tinuvin-328™ (Ciba-Geigy), dispersed in gelatin and coated on a transparent polyester sheet at a coverage of 1.0 $g.m^{-2}$. At the end of these tests, the sensitometric curves were re-read and compared with the initial curves. Status "A" red density losses from an initial value of 1.0 were recorded.

The results are reproduced in TABLE 1, in which the wavelength of maximum absorption ($\lambda_{max}$) is quoted to indicate the hue of the image dye from each of the coatings and where image dye light stability is represented by the red density loss from 1.0.

TABLE 1

Photographic Evaluation of Couplers in Monochrome Format (1:1:1 Coupler/ST1/S1)

| Coating No. | Coupler No. | $\lambda_{max}$ (nm) | HBW (nm) | HID Fade† | |
|---|---|---|---|---|---|
| 1. | C-1 | 657 | 161 | −0.11 | (inv.) |
| 2 | C-2 | 656 | 161 | −0.11 | (inv.) |
| 3 | C-3 | 658 | 162 | −0.11 | (inv.) |
| 4. | C-4 | 659 | 162 | −0.12 | (inv.) |
| 5. | C-5 | 658 | 162 | −0.10 | (inv.) |
| 6. | C-6 | 660 | 161 | −0.08 | (inv.) |
| 7. | C-7 | 660 | 160 | −0.12 | (inv.) |
| 8. | C-8 | 661 | 164 | −0.11 | (inv.) |
| 9. | C-9 | 661 | 163 | −0.10 | (inv.) |
| 10. | CC-1 | 647 | 157 | −0.18 | (comp.) |
| 11. | CC-2 | 643 | 151 | −0.31 | (comp) |

†4 wk HID Fade (uv-filter present). Density loss from 1.0.

The results show that the coatings containing the couplers C-1 to C-9 used in the invention are superior to those of the comparison couplers CC-1 and CC-2 in image dye hue because their image dyes absorb at longer wavelengths. They also exhibit image dye light stability which is superior to that of comparison couplers, CC-1 and CC-2. It is to be noted that these comparison couplers differ from coupler C-1 only in the positioning of the fluorine substitution, being ortho substituted in CC-1, ortho and meta substituted in CC-2 but meta substituted only in C-1. The unexpected advantage of having only meta and/or para-substituted fluorine containing substituents in the coupler benzamide group is hereby demonstrated.

Example 4

Preparation and Evaluation of Illustrative Coatings (b)

The coupler C-10 was dispersed and coated according to the procedures outlined in Example 3. Analogous coatings of the comparison couplers CC-3 and CC-4 were prepared in the same way. The resultant coatings were exposed and processed as described in Example 3 to provide sample strips for image stability and hue evaluation. The test procedures matched those described in Example 3, except that the light stability test was extended to 6 weeks. The results are reproduced in TABLE 2, where it is shown that the coupler C-10 gives superior image dye light stability to the otherwise identically substituted ortho and meta-fluoro-, and pentafluoro-substituted comparison couplers CC-3 and CC-4.

TABLE 2

Photographic Evaluation of Couplers in Monochrome Format (1:1:1 Coupler/ST1/S1)

| Coating No. | Coupler No. | $\lambda_{max}$ (nm) | HBW (nm) | HID Fade† | |
|---|---|---|---|---|---|
| 1. | C-10 | 665 | 172 | −0.17 | (inv.) |
| 2. | CC-3 | 654 | 167 | −0.25 | (comp.) |
| 3. | CC-4 | 673 | 170 | −0.26 | (comp.) |

†6 wk HID Fade (uv-filter present). Density loss from 1.0.

Example 5

Preparation and Evaluation of Illustrative Coatings (c)

TABLE 3 shows further results from coatings of the coupler C-6 and comparison coupler CC-5. The coatings illustrated in TABLE 3 were made from dispersions of the couplers prepared to the formulation described in Example 3, except that the coupler solvent S1 was replaced with one or other of the compounds S10 or S11. The coating formulation and evaluation procedures were the same as those outlined in Example 3.

TABLE 3

Photographic Evaluation of Couplers in Monochrome Format (1:1:1 Coupler/ST1/Solvent)

| Coating No. | Coupler No. | Solvent | $\lambda_{max}$ (nm) | HBW (nm) | HID Fade† | |
|---|---|---|---|---|---|---|
| 1. | C-6 | S10 | 652 | 150 | −0.36 | (inv.) |
| 1. | CC-5 | S10 | 645 | 155 | −0.50 | (comp.) |
| 2. | C-6 | S11 | 652 | 156 | −0.16 | (inv.) |
| 3. | CC-5 | S11 | 645 | 154 | −0.30 | (comp.) |

†4 wk HID Fade (uv-filter present). Density loss from 1.0.

The data show clearly that in both formats (i.e. with solvent S10 or S11) coupler C-6, having substituents in the meta and para positions, gives an image dye with superior light stability to that of the comparison coupler CC-5, substituted with fluorine atoms in the ortho and para positions, demonstrating once again that the presence of the ortho-fluoro substituent in CC-5 is detrimental to image dye light stability.

The invention has been described in detail with particular reference to certain preferred embodiments thereof, but it will be understood that variations and modifications can be effected within the spirit and scope of the invention.

What is claimed is:

1. A photographic element comprising a light sensitive silver halide emulsion layer having associated therewith (A) a cyan dye-forming coupler of formula (I) and (B) a bisphenol derivative compound of formula (II):

(A)

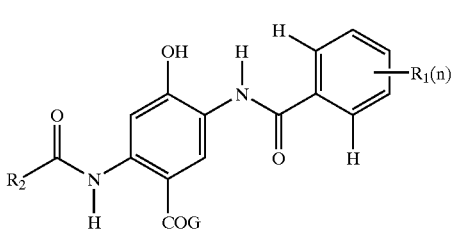

(I)

wherein each $R_1$ is a substituent provided that at least one of these is a fluoro or a perfluoroalkyl substituent;

n is an integer from 1 to 3;

$R_2$ is an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and COG is a hydrogen atom or a group which can be split off by the reaction of the coupler with an oxidized colour developing agent, provided that (c) when n is 3 and each $R_1$ is fluorine, COG is not a methoxy group and (d) when n is 2 and $R_1$ in the 3- and 4-positions is each a fluorine atom, COG is not hydrogen;

(B)

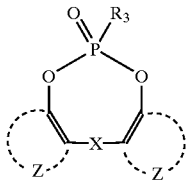

(II)

wherein $R_3$ is an unsubstituted or substituted alkyl, aryl, alkoxy, aryloxy group or a substituted amino group;

each Z independently represents the atoms necessary to complete a substituted or unsubstituted arene or heteroaromatic ring system;

X is a single bond or a linking group having a single atom which connects the arene or heteroaromatic ring systems; or X forms, together with substituents ortho to X on the arene or heteroaromatic ring systems, a fused unsubstituted or substituted 5-, 6-or 7-membered ring, which may contain one or two heteroatoms selected from nitrogen, oxygen and sulfur.

2. The photographic element of claim 1 wherein in formula (I) at least one $R_1$ is selected from fluoro and trifluoromethyl groups.

3. The photographic element of claim 1 wherein n is 2.

4. The photographic of claim 1 wherein in formula (I) $R_2$ is an alkyl group substituted with halogen or an unsubstituted or substituted alkyl, aryloxy or alkyl- or aryl-sulfonyl group.

5. The photographic element of claim 4 wherein $R_2$ is the group

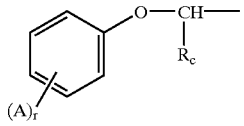

wherein each A is independently a substituent with at least one A being an alkyl- or aryl-sulfonamido or -sulfamoyl group, r is 1 or 2, and $R_c$ is hydrogen or an alkyl group.

6. The photographic element of claim 1 wherein the cyan dye-forming coupler of formula (I) is selected from

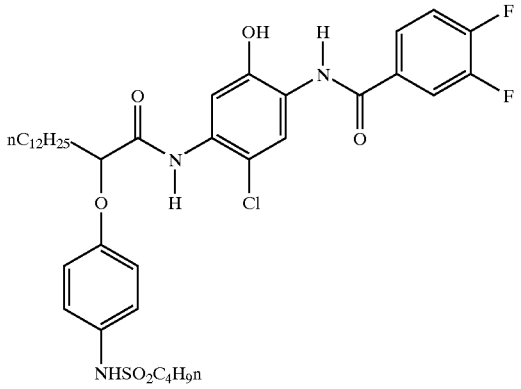

and

-continued

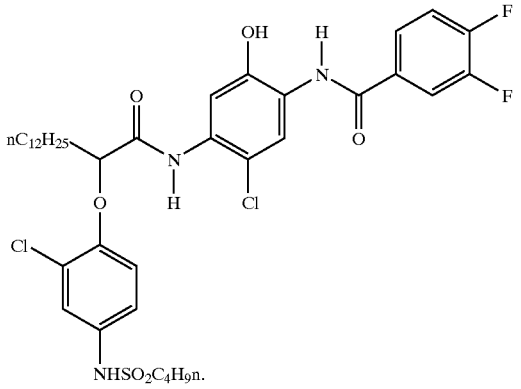

7. The photographic element of claim 1 wherein the bisphenol derivative has the formula (IIA):

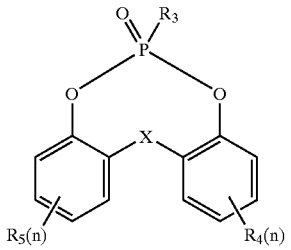

wherein $R_3$ is an unsubstituted or substituted alkyl, aryl, alkoxy, aryloxy group or a substituted amino group;

$R_4$ and $R_5$ are each independently selected from halogen or an unsubstituted or substituted alkyl, aryl, alkoxy, aryloxy, COOR or CONR'R" group, where R is an unsubstituted or substituted alkyl or aryl group, R' and R" are independently selected from hydrogen and an unsubstituted or substituted alkyl or aryl group;

each n is independently an integer from 1 to 4; and

X is a single bond or a linking group having a single atom which connects the phenyl rings; or X forms together with $R_4$ and $R_5$, when in the ortho position, a fused unsubstituted or substituted 5-, 6-or 7-membered ring, which may contain one or two heteroatoms selected from nitrogen, oxygen and sulfur.

8. The photographic element of claim 7 wherein the bisphenol derivative has the formula (IIB):

(IIB)

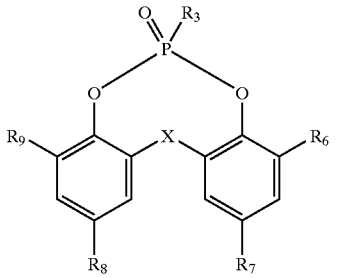

wherein $R_3$ is an unsubstituted or substituted alkyl, aryl, alkoxy, aryloxy group or a substituted amino group;

$R_6$, $R_7$, $R_8$ and $R_9$ are independently selected from hydrogen or halogen atoms or unsubstituted or substituted alkyl, aryl or alkoxy groups and X is a single bond or a linking group having a single atom which connects the phenyl rings.

9. The photographic element of claim 1 wherein X is a divalent linking group selected from —CR'R"—, —NR—, —$S(O)_q$— and —O—, wherein R is an unsubstituted or substituted alkyl or aryl group, R' and R" are independently selected from hydrogen and an unsubstituted or substituted alkyl or aryl group and is 0,1 or 2.

10. The photographic element of claim 9 wherein X is an unsubstituted or substituted methylene group or a sulfur or oxygen atom.

11. The photographic element of claim 1 wherein the ratio by weight of stabilizer to dye-forming coupler is from about 0.1:1 to about 5:1.

12. The photographic element of claim 11 wherein the stabilizer and dye-forming coupler are in equal amounts by weight.

13. A multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element comprises a light sensitive silver halide emulsion layer having associated therewith (A) a cyan dye-forming coupler of formula (I) and (B) a bisphenol derivative compound of formula (II):

(A)

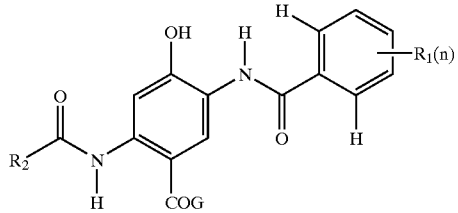

(I)

wherein each $R_1$ is a substituent provided that at least one of these is a fluoro or a perfluoroalkyl substituent;

n is an integer from 1 to 3;

$R_2$ is an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and COG is a hydrogen atom or a group which can be split off by the reaction of the coupler with an oxidized colour developing agent, provided that (a) when n is 3 and each $R_1$ is fluorine, COG is not a methoxy group and (b) when n is 2 and $R_1$ in the 3- and 4-positions is each a fluorine atom, COG is not hydrogen;

(B)

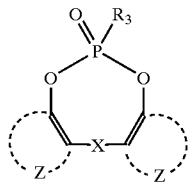

(II)

wherein $R_3$ is an unsubstituted or substituted alkyl, aryl, alkoxy, aryloxy group or a substituted amino group;

each Z independently represents the atoms necessary to complete a substituted or unsubstituted arene or heteroaromatic ring system;

X is a single bond or a linking group having a single atom which connects the arene or heteroaromatic ring systems; or X forms, together with substituents ortho to X on the arene or heteroaromatic ring systems, a fused unsubstituted or substituted 5-, 6-or 7-membered ring, which may contain one or two heteroatoms selected from nitrogen, oxygen and sulfur.

14. A process of forming an image in a photographic element after the element has been imagewise exposed to light, comprising contacting an element with a colour developing agent wherein the element comprises a light sensitive silver halide emulsion layer having associated therewith (A) a cyan dye-forming coupler of formula (I) and (B) a bisphenol derivative compound of formula (II):

(A)

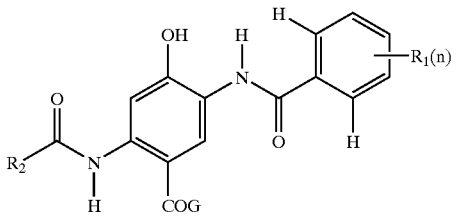

(I)

wherein each $R_1$ is a substituent provided that at least one of these is a fluoro or a perfluoroalkyl substituent;

n is an integer from 1 to 3;

$R_2$ is an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and COG is a hydrogen atom or a group which can be split off by the reaction of the coupler with an oxidized colour developing agent;

provided that (a) when n is 3 and each $R_1$ is fluorine, COG is not a methoxy group and (b) when n is 2 and $R_1$ in the 3- and 4-positions is each a fluorine atom, COG is not hydrogen;

(B)

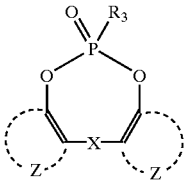

(II)

wherein $R_3$ is an unsubstituted or substituted alkyl, aryl, alkoxy, aryloxy group or a substituted amino group;

each Z independently represents the atoms necessary to complete a substituted or unsubstituted arene or heteroaromatic ring system;

X is a single bond or a linking group having a single atom which connects the arene or heteroaromatic ring systems; or X forms, together with substituents ortho to X on the arene or heteroaromatic ring systems, a fused unsubstituted or substituted 5-, 6-or 7-membered ring, which may contain one or two heteroatoms selected from nitrogen, oxygen and sulfur.

* * * * *

UNITED STATES PATENT AND TRADEMARK OFFICE

CERTIFICATE OF CORRECTION

PATENT NO. : 6,444,417 B1 
DATED : September 3, 2002
INVENTOR(S) : David Clark, Llewellyn J. Leyshon and Katie Smith It is certified that error appears in the above-identified patent and that said Letters Patent is hereby corrected as shown below:

Column 40,
Line 6, after "and" insert -- Q --

Signed and Sealed this

Twenty-ninth Day of April, 2003

JAMES E. ROGAN
*Director of the United States Patent and Trademark Office*